US008678981B2

(12) United States Patent
Cohen et al.

(10) Patent No.: US 8,678,981 B2
(45) Date of Patent: Mar. 25, 2014

(54) PORTABLE LEG EXERCISER

(75) Inventors: Richard S. Cohen, Brooklyn, NY (US); Lou Henry, Scarsdale, NY (US); Petros Stambolis, Franklin Square, NY (US)

(73) Assignee: Richard S. Cohen, Brooklyn, NY (US)

( * ) Notice: Subject to any disclaimer, the term of this patent is extended or adjusted under 35 U.S.C. 154(b) by 305 days.

(21) Appl. No.: 13/195,124

(22) Filed: Aug. 1, 2011

(65) Prior Publication Data

US 2013/0035213 A1 Feb. 7, 2013

(51) Int. Cl.
*A63B 22/04* (2006.01)

(52) U.S. Cl.
USPC ..... 482/52; 482/51; 482/70; 482/79; 482/141

(58) Field of Classification Search
USPC ..... 482/52, 44–50, 66, 68, 79, 82, 92, 131, 482/133, 135–137, 139, 142, 148, 121–130, 482/141
See application file for complete search history.

(56) References Cited

U.S. PATENT DOCUMENTS

| | | | | |
|---|---|---|---|---|
| 3,941,377 | A | 3/1976 | Lie | |
| 4,023,795 | A | 5/1977 | Pauls | |
| 4,434,981 | A | 3/1984 | Norton | |
| 4,512,571 | A | 4/1985 | Hermelin | |
| 4,618,139 | A | 10/1986 | Haaheim | |
| 4,632,385 | A | 12/1986 | Geraci | |
| 4,684,121 | A | 8/1987 | Nestegard | |
| 5,145,481 | A * | 9/1992 | Friedebach | 482/70 |
| 5,181,894 | A | 1/1993 | Shieng | |
| 5,342,264 | A | 8/1994 | Gordon | |
| 5,833,584 | A | 11/1998 | Piaget et al. | |
| 6,280,366 | B1 * | 8/2001 | Hsieh | 482/130 |
| 6,572,514 | B1 | 6/2003 | Calafato | |
| 6,709,368 | B1 | 3/2004 | Chue | |
| 6,837,838 | B2 | 1/2005 | List | |
| 7,125,367 | B1 * | 10/2006 | Stearns | 482/141 |
| 7,556,592 | B2 | 7/2009 | Nizam | |
| 7,645,218 | B2 * | 1/2010 | Potok | 482/141 |
| 7,736,285 | B2 | 6/2010 | Brown, Jr. | |
| 7,892,152 | B1 * | 2/2011 | Teng | 482/79 |
| 2001/0036885 | A1 | 11/2001 | Castello, Jr. et al. | |
| 2004/0053752 | A1 * | 3/2004 | Yang | 482/70 |
| 2005/0250621 | A1 * | 11/2005 | Corbalis et al. | 482/52 |
| 2011/0045950 | A1 * | 2/2011 | Wu | 482/4 |

* cited by examiner

*Primary Examiner* — Loan Thanh
*Assistant Examiner* — Nyca T Nguyen
(74) *Attorney, Agent, or Firm* — Gordon & Jacobson, PC

(57) ABSTRACT

A compact leg exerciser includes two portions rotatable about a hinge. Each portion includes a base and a foot pedal displaceable along the base. The pedals include stops located longitudinally inward of the wheels. Each base is provided with resilient limiters for contacting against the stops of the pedals to limit travel of the pedals and thereby prevent the pedals from contacting the longitudinal ends of the periphery. The hinge is offset from the sides of each base and forms a handle for transporting the leg exerciser when the exerciser is folded about the hinge into a closed position.

17 Claims, 2 Drawing Sheets

PORTABLE LEG EXERCISER

FIELD OF THE INVENTION

The present invention relates to exercise equipment. More particularly, the invention relates to portable equipment for the exercise of the legs.

BACKGROUND OF THE INVENTION

Various types of exercise equipment particularly adapted to exercise specific portions of the human body are well-known. Exercise equipment often provides resistance, and the user operates against such resistance to tone and/or build various muscle groups. Such equipment may include weight-resistance devices, as well as stationary bikes and elliptical motion devices that are computer controlled to moderate the resistance applied, and thus the effort required for the user to operate the devices. Other equipment does not rely on resistance, but rather provides a controlled and measured rate of movement that the user is required to maintain. For example, active treadmills require the user to maintain a set speed.

There are a larger number of devices for the exercise and enhanced mobility of the lower legs and feet while an individual remains in a seated position. Such devices are useful for individuals who spend significant portions of their day in a sedentary state. The minimal lower leg muscle movement of deskbound or otherwise sedentary individual can result in decreased muscle tone, reduced circulation, and lower metabolic rate. Further, during airplane travel, limited leg movement over lengthy flights has been shown to increase risk for deep vein thrombosis and pulmonary embolism. Using an exercise device, even while seated, can increasing lower leg and feet mobility to provide increased muscle tone, vascular circulation and metabolic rates, countering the effects of being otherwise sedentary and inactive.

While devices are known for use while seated, they are often too large and bulky. For example, US Pub. No. 2001/0036885A1 to Castellot, Jr. et al. discloses an exerciser for shuffling a user's legs back and forth. However, this purportedly compact device includes two side-by-side tracks, each approximately 30 inches long, and foot pedals that have a travel of more than twice their own length. A device of such dimensions and used in this manner is impractical for the limited space between seat rows on an airplane. In addition, a device of such dimensions when used beneath a desk would potentially inhibit user movement or limit placement of the user's chair relative to the desk such that good ergonomic placement of the user relative to the desk would be difficult to maintain.

Therefore, it is advantageous that the exercise device easily fit within the space beneath a desk and in front of the user's chair. Similarly, for use on an airplane, a very small and low profile in-use size is required. Currently available devices do not meet such size requirement. Furthermore, available devices do not store to a size and shape convenient for travel.

SUMMARY OF THE INVENTION

According to the invention, a compact leg exerciser is provided. The leg exerciser includes two portions that are rotatable about a hinge. Each portion includes a track and a foot pedal longitudinally displaceable along the track. The foot pedals are sized to receive a user's foot. The pedals preferably travel on four wheels mounted on axles at the longitudinal ends of the pedals. The pedals include stops located longitudinally inward of each of the four wheels.

Each track includes a base with a periphery defined by lateral sides and longitudinal ends. The ends of the track are preferably lower than the sides, thereby defining a recess for easier foot access onto the pedals. The lateral sides of the track have a longitudinal center, and longitudinally centered thereabout are resilient limiters for contacting against the stops of the pedals to limit travel of the pedals and thereby prevent the pedals from contacting the longitudinal ends of the periphery. The resilient limiters also assist in returning each pedal in an opposing direction once the pedal reaches the limiters. A track cover extends over the wheels and stops of the pedals to capture and retain the pedals relative to the base. The track length preferably does not exceed twice the pedal length, and is more preferably a length approximately equal to one and one-half times the length of the pedal. The track length is preferably no more than 24 inches, and more preferably less than 18 inches in length. The pedals are preferably less than 12 inches in length. These relative dimensions permit sufficient movement of the pedal on the track for the desired leg mobility while preserving a compact shape and size.

The tracks are spaced apart by the hinge. The hinge is defined by respective hinge members extending from a lateral side of each track. The hinge members are coupled together at a fixed pivot axis, allowing the tracks the fold relative to each other in a direction that brings the flanges of the pedals into contact when in a fully closed position. When the tracks are folded about the pivot axis into the closed position, the hinge forms a handle for transporting the leg exerciser.

DETAILED DESCRIPTION OF THE PREFERRED EMBODIMENTS

Figure 3:
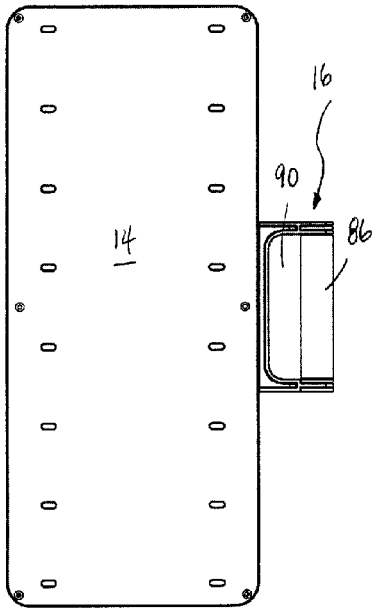
FIG. 3 is a plan of the compact leg exerciser of the invention in a closed position.
Figure 1:
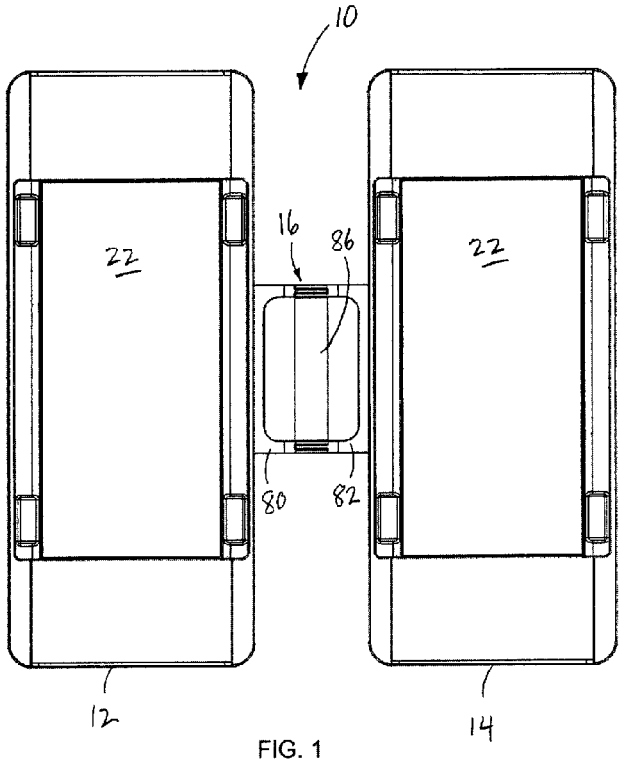
FIG. 1 is a plan view of the compact leg exerciser of the invention in an open position.
Figure 4:
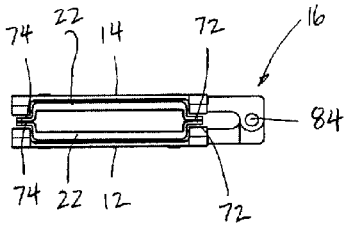
FIG. 4 is an end view of the compact leg exerciser in the closed position.
Figure 2:
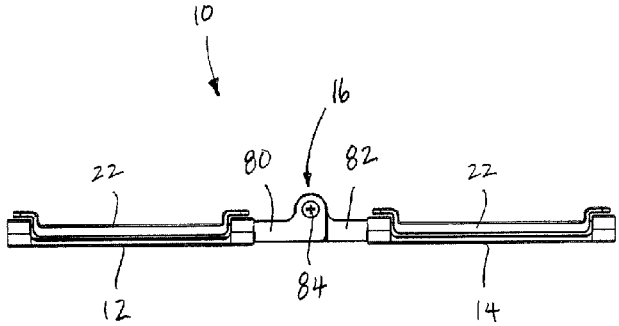
FIG. 2 is an end view of the compact leg exerciser of FIG. 1.

Referring now to FIGS. 1 through 4, a compact leg exerciser 10 according to the invention is shown. The exerciser includes left side portion 12 for receiving user's left foot and a right side portion 14 for receiving a user's right foot. The left and right side portions 12, 14 are rotatable on a hinge 16 between open and closed positions. In the open position, the left and right side portions 12, 14 are configured to lie flat on a planar surface (as shown in FIGS. 1 and 2), and in a closed position, the left and right side portions are folded into contact with each other to assume a size of substantially one half its size in the open position (FIGS. 3 and 4).

Figure 5:
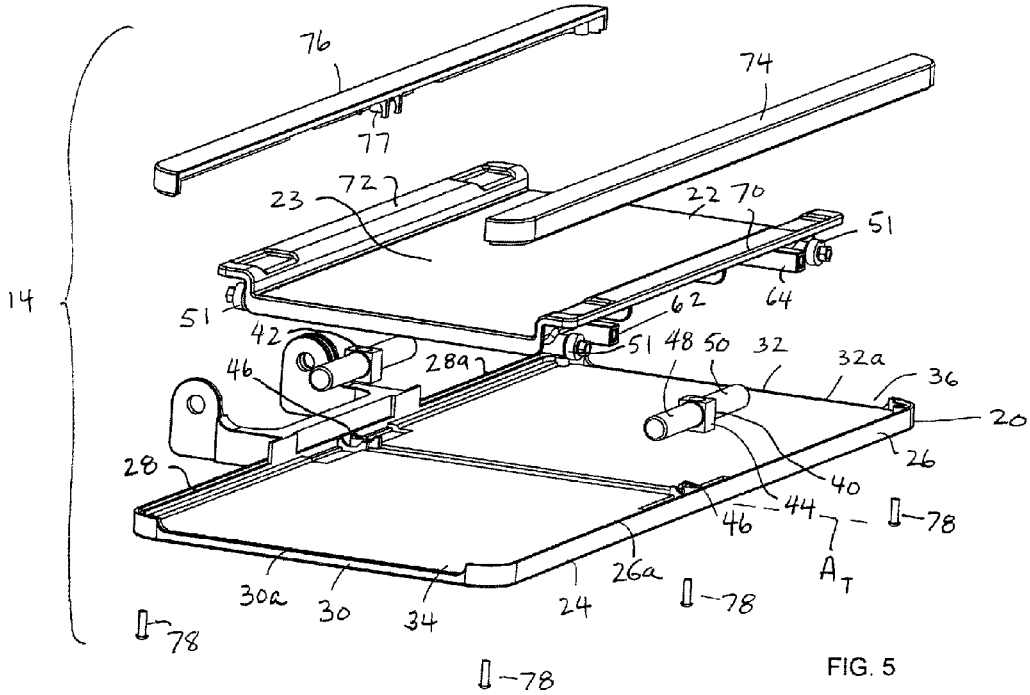
FIG. 5 is an exploded view of a portion of the compact leg exerciser including a track and a pedal.

Turning to FIG. 5, the left and right side portions (shown with respect to the right side portion 14 of the exerciser, it being appreciated that the left side portion is substantially a mirror image thereof) each include a preferably substantially rigid plastic, rectangular base (or track) 20 and a preferably substantially rigid plastic foot pedal 22 longitudinally displaceable along the base. The base 20 includes a periphery 24 defined by lateral sidewalls 26, 28 and longitudinal ends 30, 32. While the base 20 preferably has a substantially closed bottom, it may be open at central portions thereof. The ends 30, 32 of the base have top edges 30*a*, 32*a* that are preferably lower than the top edges 26*a*, 28*a* of the sidewalls 26, 28, thereby defining recesses 34, 36 for facilitating use of the pedal 22, as discussed below. In addition, the recesses permit a pedal to be used that is shorter than a user's foot, allowing the foot to extend forward and rearward of the ends 30, 32 without contacting the base while the foot displaces the pedal on the base. The base 20 has a transverse axis $A_T$ extending through its longitudinal center. The base preferably has a length of less than 24 inches, and more preferably less than 18 inches. One preferred set of dimensions for the base is approximately 16.6 inches in length, approximately 6.85 inches in width, and approximately 0.75 inch in height.

Resilient limiters 40, 42 for limiting travel of the pedal 22 are located on the base centered about the transverse axis $A_T$. Each resilient limiter, e.g., limiter 40, includes a rigid mount 44 stabilized relative to a lower bracket 46 on the base 20, and opposing resilient elements 48, 50 mounted on opposite sides of the mount 44. The rigid mount 44 is more preferably press-fit into or otherwise held between the lower bracket 46 located at the longitudinal center of the base 20 and an upper bracket 77 located at the longitudinal center of the track covers 74, 76, described below, such that the rigid mount is vertically sandwiched between the two brackets 46, 77. The resilient elements 48, 50 may be coil springs, leaf springs, other springs, natural and man-made rubber-like stops, dense foam stops, etc. The resilient limiters 40, 42 limit travel of the pedal 22, as discussed further below, and thereby prevent the pedal from hard-contacting the longitudinal ends 30, 32 of the periphery 24 of the base 20. The resilient limiters 40, 42 preferably also assist in returning the pedal 22 in an opposing direction once the pedal 22 contacts the limiters. The resilient limiters 40, 42 are integral to permitting the leg exerciser to be within the defined relative dimension relative to the pedals, and providing a device that can be no more than 24 inches.

Figure 6:
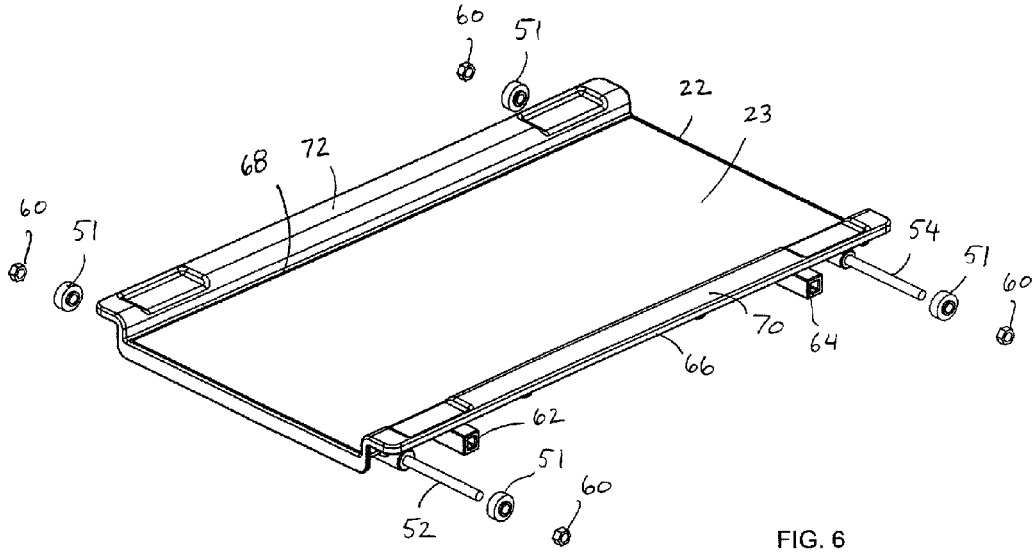
FIG. 6 is an assembly view of a foot pedal of the compact leg exerciser.

Referring to FIG. 6, the foot pedal 22 includes a lower footpad 23 sized to receive a user's foot. The footpad 23 may be sized to receive the user's whole foot, or an adult foot in at least a widthwise direction, with toe and/or heel portions of the user's foot extending possibly beyond the footpad 23. Ideally, the footpad 23 is sized to receive at least the ball portion of the user's respective foot. The foot pedal preferably has a length of less than 12 inches. The footpad 23 is preferably resides lower than the top edges 26*a*, 26*b* of the sidewalls 26, 28. The pedal 22 preferably travels on four wheels 51. The wheels 51 are mounted on first and second axles 52, 54 at the longitudinal ends of the pedal 22, and are retained on the axles 52, 54 with caps 60. As an alternative to wheels 51, low friction glides, ball bearings or other structure which allows the pedals 22 to smoothly displace on the base when a foot is placed thereon can also be used. The side of the pedal 22 includes substantially rigid stops 62, 64 located longitudinally inward of each of the four wheels 51. As the pedal is advanced and retracted along the base 20, the stops 62, 64 contact the resilient limiters 40, 42 at the center of the base, thereby limiting travel of the pedal and also assisting in return of the pedal in an opposite direction. The pedal 22 also includes sidewalls 66, 68 that retain the user's foot on the footpad 23 and within the lateral bounds of the pedal 22 (by preventing contact of the user's foot against the lateral sidewalls 26, 28 of the base 20), and optional upper flanges 70, 72 that extends laterally outward from the sidewalls 66, 68. The flanges 70, 72 provide stability to the pedals and, should the user bear his or her weight on a pedal 22, help to distribute such weight across a greater area of the base 20 to prevent damage to the wheels 51 and axles 52, 54. One preferred set of dimensions for the foot pedal is approximately 10.6 inches in length, approximately 6.5 inches in width, and approximately 0.8 inches in height.

Track covers 74, 76 extend over the wheels 51 and the stops 62, 64 of the pedal 22 (and under the flanges 70, 72) to capture and retain the pedal 22 relative to the base 20. The track cover 74, 76 also includes the upper bracket 77 for the limiters, such that the limiters 40, 42 are secured in position, e.g., by clamping, between upper and lower brackets 46, 77. The track covers 74, 76 are preferably secured to the base 20 with screws 78, although other securing means including bonding with adhesives and sonic welding can be used.

According to one preferred aspect of the invention, the length of the base 20 preferably does not exceed twice the length of the pedal 22, and more preferably the length of the base is approximately equal to (i.e., ±15%) one and one-half times the length of the pedal. For example, in accord with such aspect of the invention, the pedal may be 10.65 inches, and the base may be 16 inches. These relative dimensions permit sufficient pedal-to-base movement to provide the user feet movement necessary to achieve the exercise benefits the foot mobility the device affords while preserving a compact shape and size.

Referring back to FIGS. 1 through 4, as mentioned above, the left and right side portions 12, 14 are rotatable on hinge 16. The hinge 16 is an offset hinge, defined by respective hinge members 80, 82 that extend outward from a facing lateral side of each side portion and which are rotatable about a hinge pin 84 that is offset from and located between the base 20, but not directly adjacent to either of the tracks. The structure of the hinge 16 operates to space the left and right portion bases 20 apart such that when the exerciser is in the open position the bases 20 are located in a side-by-side, spaced-part, non-contacting relationship. The left and right side portions 12, 14 fold about the hinge pin 84 from the open position to a fully closed, compact position. As shown in FIG. 4, the flanges 70, 72 of the left and right pedals 22 contact each other when in the fully closed position. When the left and right side portions 12, 14 are folded about the hinge pin 84 into the closed position, the offset hinge pin at least partly forms a handle sufficiently spaced apart from the left and right side portions to define an opening 90 (FIG. 3) such that a user can insert at least one finger of the user's hand between the defined hinge 'handle' and the left and right side portions to support and transport the exerciser by the handle. The opening defined between the hinge 'handle' and the folded bases in one embodiment is 4 inches in length and 0.87 inches in depth. The offset of the hinge is further located to correctly position the pedals in a spaced relation relative to a user's feet when the left and right side positions 12, 14 are unfolded into the open position. The hinge pin 84 may be additionally formed with an enlarged diameter central portion or with an overlying outer collar 86 of larger outer diameter to facilitate its function as a handle.

In use, the device is configured into the open position and placed on a planar surface. The user positions his feet on the respective left and right pedals and shuffles his feet back and forth such that the pedals are moved in opposite directions on the left and right bases. With respect to left foot, the left pedal is advanced along the left base until the proximal stop on the pedal contacts the proximally directed, centrally positioned resilient limiter, which limits distal travel of the pedal. In addition, the proximally directed resilient limiter urges movement of the left pedal and proximal direction. The user then moves his foot in the proximal direction until the distal stop on the pedal contacts the distally directed, centrally positioned resilient limiter, which limits proximal travel of the pedal. Similarly, the distally directed resilient limited now urges movement of the pedal in the opposite direction. The movement is repeated for each foot such that the user can easily move his feet in a shuffling motion in a limited amount of space to obtain mobility to one's legs while seated and where little space is available for leg movement.

There have been described and illustrated embodiments of a compact leg exerciser. While particular embodiments of the invention have been described, it is not intended that the invention be limited thereto, as it is intended that the invention be as broad in scope as the art will allow and that the specification be read likewise. Thus, while the resilient limiter have been described on the base, and the rigid stops on the pedals, the parts may be reversed, with the pedals provided with the resilient elements, and the base provided with the rigid stop at a central location. Further, while it is preferred that the left and right portions be hingedly coupled together, it is appreciated that for stationary placement, such as substantially permanent placement under a desk, it may be suitable to have a construct in which the left and right portions are in a substantially fixed planar, open configuration. Also, where the term 'approximately' has been used in reference with a dimension, the term 'approximately' is meant to include ±15 percent of the stated dimension. It will therefore be appreciated by those skilled in the art that yet other modifications could be made to the provided invention without deviating from its spirit and scope as claimed.

What is claimed is:

1. A leg exerciser, comprising:

a) a left portion including a left base and a left pedal for receiving a portion of a user's left foot, said left pedal retained relative to said left base and longitudinally displaceable relative to said left base, said left portion including a longitudinally centrally located first limiter which limits travel of said left pedal on said left base, said first limiter including opposing resilient members, said left pedal including stops for contacting said resilient members, said resilient members located longitudinally between said stops;

b) a right portion including a right base and a right pedal for receiving a portion of a user's right foot, said right pedal retained relative to said right base and longitudinally displaceable relative to said right base, said right portion including a longitudinally centrally located second limiter to limit travel of said right pedal on said right portion, said second limiter including opposing resilient members, said right pedal including stops for contacting said resilient members, said resilient members located longitudinally between said stops;

c) a first cover portion for said left portion; and d) a second cover portion for said right portion, wherein said left base and said first cover portion include respective mating structure that together retains said first limiter, and said right base and said second cover portion include respective mating structure that together retains said second limiter.

2. A leg exerciser according to claim 1, wherein:

said left pedal includes wheels, and is displaceable relative to said left portion on said wheels, and said stops are located longitudinally central of said wheels, and said right pedal includes wheels, and is displaceable relative to said right portion on said wheels, and said stops are located longitudinally central of said wheels.

3. A leg exerciser according to claim 2, wherein:

said left pedal and said right pedal each includes four corners and four wheels one at each corner, and said stops of each of said left pedal and said right pedal are coupled respectively to said left pedal and to said right pedal longitudinally inward of each of said four wheels.

4. A leg exerciser according to claim 1, wherein:

said left and right pedals each have a common first length, and said left and right bases each have a common second length that is less than 24 inches and does not exceed twice said first length.

5. A leg exerciser according to claim 4, wherein:

said second length is approximately one and one-half times said first length.

6. A leg exerciser according to claim 1, wherein said left base includes a periphery having sidewalls and longitudinal ends, at least one of said ends defining an upper recess such that a top edge of at least one of said ends is lower than a top edge of said sidewalls, and said right base includes a periphery having sidewalls and longitudinal ends, at least one of said ends defining an upper recess such that a top edge of at least one of said ends is lower than a top edge of said sidewalls.

7. A leg exerciser according to claim 1, wherein:

a hinge about which said left and right portions are rotatable between an open position in which said left and right portions are configured for stable placement on a planar surface and a closed position in which said left and right portions are rotated to overlie each other.

8. A leg exerciser, comprising:

a) a left portion including a left base and a left foot pedal for receiving a portion of a user's left foot, said left foot pedal retained relative to and longitudinally displaceable relative to said left base;

b) a right portion including a right base and a right foot pedal for receiving a portion of a user's right foot, said right foot pedal retained relative to and longitudinally displaceable relative to said right base;

c) an offset hinge including first and second hinge members, said first hinge member coupled to said left portion and extending laterally inward relative to said left portion, said second hinge member coupled to said right portion and extending laterally inward relative to said right portion, said first and second hinge members rotatable about a hinge pin between open and closed positions, wherein when said left and right portions are rotated on said offset hinge into the open position, said left and right portions are configured for stable placement on a planar surface, and wherein when said left and right portions are rotated on said offset hinge into the closed position, said left and right pedals are rotated to overlie each other, and in said closed position hinge pin at least partly defines a handle sufficiently spaced apart from said left and right portions such that a user can insert at least one finger of the user's hand between said handle and said first and second portions to support said exerciser by said handle, and said left base includes a periphery having two sidewalls and two longitudinal ends, at least one of said ends defining an upper recess such that a top edge of at least one of said ends is lower than a top edge of said sidewalls, and said right base includes a periphery having two sidewalls and two longitudinal ends, at least one of said ends defining an upper recess such that a top edge of at least one of said ends is lower than a top edge of said sidewalls.

9. A leg exerciser according to claim 8, wherein:

said left and right pedals each have a common first length, and said left and right bases each have a common second length that does not exceed twice said first length.

10. A leg exerciser according to claim 9, wherein:

said second length is approximately one and one-half times said first length.

11. A leg exerciser according to claim 8, wherein:

said hinge pin includes an enlarged diameter at a central portion thereof.

12. A leg exerciser according to claim 8, further comprising:

a collar extending over a central portion of said hinge pin to provide a larger diameter to said handle over said central portion.

13. A leg exerciser according to claim 8, wherein:

both of said ends of said periphery of said left base define a top edge that is lower than said top edges of said sidewalls of said periphery of said left base, and both of said ends of said periphery of said right base define a top edge that is lower than said top edges of said sidewalls of said periphery of said right base.

14. A leg exerciser according to claim 8, wherein:

said left foot pedal includes a footpad, and said footpad resides lower than said top edge of said sidewalls of said periphery of said left base when said leg exerciser is in said open position, and said right foot pedal includes a footpad, and said footpad resides lower than said top edge of said sidewalls of said periphery of said right base when said leg exerciser is in said open position.

15. A leg exerciser, comprising:

a) a left portion including, i) a left base having a periphery having sidewalls and longitudinal ends, at least one of said ends defining an upper recess such that a top edge of at least one of said ends is lower than a top edge of said sidewalls, and ii) a left pedal having a footpad for receiving a portion of a user's left foot, said left foot pedal retained relative to said left base and longitudinally displaceable relative to said left base, and said footpad of said left pedal residing lower than said top edge of said sidewalls of said periphery of said left base;

b) a right portion coupled to said left portion, said right portion including, i) a right base having a periphery having sidewalls and longitudinal ends, at least one of said ends defining an upper recess such that a top edge of at least one of said ends is lower than a top edge of said sidewalls, and said footpad of said right pedal residing lower than said top edge of said sidewalls of said periphery of said right base, and ii) a right pedal for receiving a portion of a user's right foot, said right foot pedal retained relative to said right base and longitudinally displaceable within said right base; and c) a hinge coupling said left and right portions together and about which said left and right portions are rotatable between an open position in which said left and right portions are configured for stable placement on a planar surface and a closed position in said left and right portions are rotated to overlie each other.

16. A leg exerciser according to claim 15, wherein:

said hinge is an offset hinge including first and second hinge members and a hinge pin rotatably coupling said first and second hinge members, and in said closed position said hinge pin at least partly defines a handle sufficiently spaced apart from said left and right portions such that a user can insert at least one finger of the user's hand between said handle and said first and second portions to support said exerciser by said handle.

17. A leg exerciser, comprising:

a) a left portion including a left base and a left pedal for receiving a portion of a user's left foot, said left pedal retained relative to said left base and longitudinally displaceable relative to said left base, said left portion including a longitudinally centrally located first limiter which limits travel of said left pedal on said left base, said first limiter including opposing resilient members, said left pedal including stops for contacting said resilient members, said resilient members located longitudinally between said stops; and b) a right portion including a right base and a right pedal for receiving a portion of a user's right foot, said right pedal retained relative to said right base and longitudinally displaceable relative to said right base, said right portion including a longitudinally centrally located second limiter to limit travel of said right pedal on said right portion, said second limiter including opposing resilient members, said right pedal including stops for contacting said resilient members, said resilient members located longitudinally between said stops, wherein said left base includes a periphery having sidewalls and longitudinal ends, at least one of said ends defining an upper recess such that a top edge of at least one of said ends is lower than a top edge of said sidewalls, and said right base includes a periphery having sidewalls and longitudinal ends, at least one of said ends defining an upper recess such that a top edge of at least one of said ends is lower than a top edge of said sidewalls.

* * * * *